US010640288B2

(12) United States Patent
Lucas et al.

(10) Patent No.: US 10,640,288 B2
(45) Date of Patent: May 5, 2020

(54) ROTARY CLAMSHELL GATE ACTUATOR FOR BULK MATERIAL CONTAINER

(71) Applicant: Halliburton Energy Services, Inc., Houston, TX (US)

(72) Inventors: Bryan Chapman Lucas, Duncan, OK (US); Calvin L. Stegemoeller, Duncan, OK (US); Austin Carl Schaffner, Duncan, OK (US); Wesley John Warren, Marlow, OK (US); Bryan John Lewis, Duncan, OK (US); Tori H. Miller, Duncan, OK (US); Thomas W. Hawkins, Marlow, OK (US); Glenn Ray Fowler, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 15/575,437

(22) PCT Filed: Jul. 22, 2015

(86) PCT No.: PCT/US2015/041581

§ 371 (c)(1),
(2) Date: Nov. 20, 2017

(87) PCT Pub. No.: WO2017/014774

PCT Pub. Date: Jan. 26, 2017

(65) Prior Publication Data

US 2018/0194552 A1 Jul. 12, 2018

(51) Int. Cl.
*B65D 90/62* (2006.01)

(52) U.S. Cl.
CPC ..... *B65D 90/623* (2013.01)

(58) Field of Classification Search
CPC .... B65D 90/62; B65D 90/623; B65D 90/626; B65D 90/54; B65D 90/66; B65D 90/125;
(Continued)

(56) References Cited

U.S. PATENT DOCUMENTS 2,812,970 A * 11/1957 Martinson ..... B65D 90/582 294/68.24
3,521,925 A * 7/1970 Heal ..... B65D 90/582 294/68.24

(Continued)

OTHER PUBLICATIONS

International Preliminary Report on Patentability issued in related PCT Application No. PCT/US2015/041581 dated Feb. 1, 2018 (10 pages).

(Continued)

*Primary Examiner* — Glenn F Myers
(74) *Attorney, Agent, or Firm* — John W. Wustenberg; Baker Botts L.L.P.

(57) ABSTRACT

In accordance with presently disclosed embodiments, systems and methods for managing dry bulk material efficiently at a well site or other location are provided. Present embodiments are directed to a rotary clamshell gate actuation system and method, where the gate is separate from the one or more actuators used to open/close the gate. The disclosed system may include a portable bulk material container with a clamshell gate for easily dispensing material from the container. The system also includes a support structure equipped with one or more rotary actuators used to actuate the clamshell gate of the container between a closed and open position when the container is positioned on the support structure. The disclosed clamshell gate actuation system is easy to operate, low cost to manufacture, and reliable even when the portable container is not precisely aligned on the support structure.

19 Claims, 11 Drawing Sheets

(58) Field of Classification Search
CPC ..... B65D 90/12; B65D 90/582; B65D 88/26; B65D 88/28; B65D 88/30; B65D 88/32; B65D 88/12; B65D 88/128; B65D 88/129; B65D 88/18; B65D 2590/54; B65D 2590/66; B65D 2590/547; B65D 2590/662; B65D 2590/664; B65D 2590/666; B65D 2590/668; B65D 2547/04; B65D 90/585; B65G 65/30; B65G 65/36; B65G 65/365; B65G 67/24; B60P 1/56; B28C 7/0076; B65B 69/0083; B65B 69/0091
USPC ..... 414/403, 414, 810; 298/38, 25, 27
See application file for complete search history.

(56) References Cited

U.S. PATENT DOCUMENTS 3,729,121 A * 4/1973 Cannon ..... B65D 90/623 222/185.1
3,836,023 A * 9/1974 Peterson ..... B61D 7/30 414/388
3,994,238 A 11/1976 Adler
4,009,664 A 3/1977 Fearon
4,224,877 A 9/1980 Stark et al.
4,236,458 A 12/1980 Varda
4,250,814 A 2/1981 Stark et al.
4,550,665 A 11/1985 Brouwer
4,705,125 A * 11/1987 Yamada ..... B65D 90/623 177/108
4,843,974 A 7/1989 Ritter et al.
4,925,356 A * 5/1990 Snead ..... E01B 27/02 414/339
5,606,916 A * 3/1997 Murray ..... B61D 7/28 105/240
6,067,912 A * 5/2000 Miller ..... B61D 7/28 105/240
6,749,268 B1 * 6/2004 Wheeler ..... B60P 1/56 298/29
8,505,780 B2 8/2013 Oren
8,585,341 B1 11/2013 Oren et al.
8,668,430 B2 3/2014 Oren et al.
8,827,118 B2 9/2014 Oren
2004/0206646 A1 10/2004 Goh et al.
2008/0223252 A1 * 9/2008 Forbes ..... B61D 7/02 105/280
2012/0212032 A1 8/2012 Hauth et al.
2015/0360856 A1 * 12/2015 Oren ..... B65G 65/42 414/411

OTHER PUBLICATIONS

International Search Report and Written Opinion issued in related PCT Application No. PCT/US2015/041581 dated Apr. 14, 2016, 13 pages.

* cited by examiner

ROTARY CLAMSHELL GATE ACTUATOR FOR BULK MATERIAL CONTAINER

CROSS-REFERENCE TO RELATED APPLICATION

The present application is a U.S. National Stage Application of International Application No. PCT/US2015/041581 filed Jul. 22, 2015, which is incorporated herein by reference in its entirety for all purposes.

TECHNICAL FIELD

The present disclosure relates generally to transferring dry bulk materials, and more particularly, to a support structure with an actuator for opening/closing a rotary clamshell gate of a portable bulk material container.

BACKGROUND

Bulk material handling systems are used in a wide variety of contexts including, but not limited to, drilling and completion of oil and gas wells, concrete mixing applications, agriculture, and others. In existing bulk material handling applications, dry material (e.g., sand, proppant, gel particulate, dry-gel particulate, aggregate, feed, and other solid materials) may be transported in a number of ways. In the formation of wellbore treatment fluids, for example, bulk material is often transferred between transportation units, storage tanks, blenders, and other on-site components via pneumatic transfer, sand screws, chutes, conveyor belts, and other components.

Recent developments in bulk material handling operations involve the use of portable containers for transporting dry material about a well location. The containers can be brought in on trucks, unloaded, stored on location, and manipulated about the well site when the material is needed. The containers are generally easier to manipulate on location than a large supply tank trailer. The containers are eventually emptied by dumping the contents thereof to a desired destination.

In traditional container-based bulk material transfer, portable containers generally include a discharge gate at the bottom of the container that can be actuated to empty bulk material from the container at a desired time and location. In applications where several portable containers are used throughout an operation, it is desirable to utilize containers with discharge gates that are both easy to actuate and low cost to manufacture.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
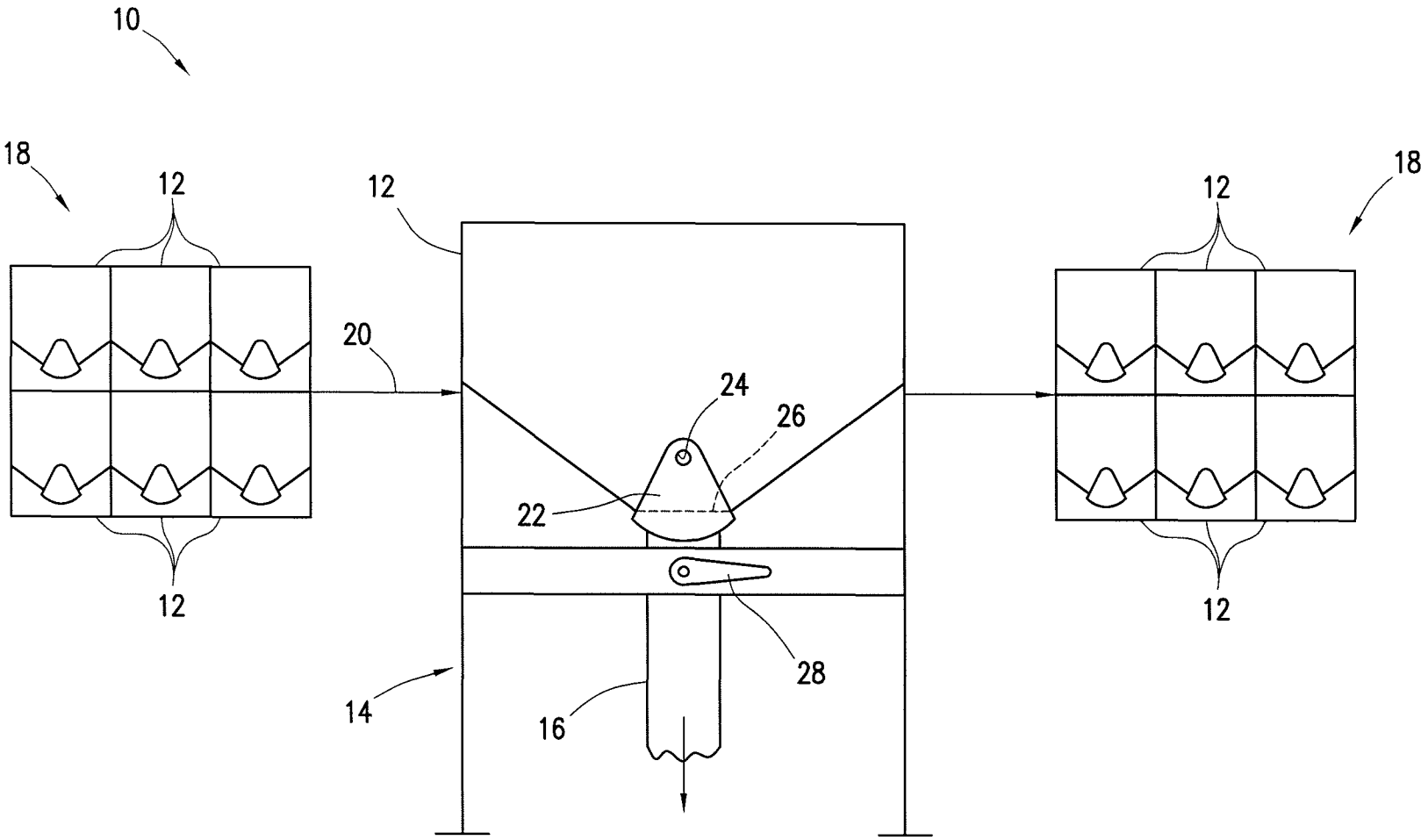
FIG. 1 is a schematic block diagram of a bulk material handling system suitable for releasing bulk material from an elevated container via a rotary clamshell gate, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for managing dry bulk material efficiently at a well site or other location. The systems and methods may involve the use of portable containers of bulk material (e.g., pre-filled containers or filled on location) designed to output bulk material through a specially actuated rotary clamshell gate. The disclosed techniques may be used to efficiently handle any bulk material having a solid constituency including, but not limited to, sand, proppant, gel particulate, dry-gel particulate, aggregate, feed, and others.

In currently existing bulk material handling applications, dry material may be transported in a number of ways. In the formation of wellbore treatment fluids, for example, the bulk material is often transferred between transportation units, storage tanks, blenders, and other on-site components via pneumatic transfer, sand screws, chutes, conveyor belts, and other components. Recently, a new method for transferring sand, or proppant, to a hydraulic fracturing site involves using portable bulk material containers to transport the dry material. The containers can be brought in on trucks, unloaded, stored on location, and manipulated about the well site when the material is needed. These containers generally include a discharge gate (e.g., swing gate, knife gate, or linear actuated clamshell gate) at the bottom that can be actuated to empty the dry material contents of the container at a desired time and location.

In order to reduce the cost and complexity of the containers themselves, actuators (i.e., devices used to actuate the discharge gate) can be attached to a separate support structure and designed to interface with the discharge gate of whatever container is placed onto the support structure. Although discharge gates can take many forms, in such systems the containers feature a type of discharge gate known as a "knife gate", as these are the simplest gates to interface with a separate actuator. A knife gate generally relies on horizontal actuation via an actuator to slide the gate horizontally out of the way, thereby forming an opening in the bottom of the container through which bulk material can exit. Unfortunately, knife gates have certain limitations, such as needing very tight manufacturing tolerances to form a complete seal when used with sand and similarly fine bulk material particles. These tight tolerances increase the cost of manufacturing such gates.

Rotary clamshell gates are generally more reliable and cheaper to manufacture than knife gates when used to store and release relatively fine bulk material particles. This is because clamshell gates do not rely on a metal-to-metal seal to block the flow of bulk material when the gate is closed. Instead, the bulk material itself creates a seal between the opening in the bottom of the container and the top of the clamshell gate when the gate is positioned over the opening.

Clamshell gates are routinely used in stationary bulk material containers as well as some transportable containers (e.g., belly-dump trailers and rail cars). In existing systems, clamshell gates are often opened and closed using a pivoting linear actuator. In general, these actuators are integral to the structure of the clamshell gate and the container. That is, the clamshell gate actuators are usually fixed between a stationary portion of the container and the movable clamshell gate and activated to move the clamshell gate between an open and a closed position. This is a relatively complicated setup that can increase the cost of manufacturing the individual containers, each having integral gate actuators.

The bulk material container handling systems disclosed herein are designed to address and eliminate the shortcomings associated with existing containers and gate actuators. Present embodiments are directed to a rotary clamshell gate actuation system and method, where the gate is separate from the one or more actuators used to open/close the gate. The disclosed system may include a portable bulk material container with a clamshell gate for easily dispensing material from the container. The system also includes a support structure equipped with one or more rotary actuators used to actuate the clamshell gate of the container between a closed and open position when the container is positioned on the support structure.

The disclosed systems and methods leverage the operational advantages of the clamshell gate with the ease of actuation of a horizontal knife gate. The clamshell gate enables more reliable gate operation for dispensing dry bulk material at a lower cost than conventional knife gates since no metal-to-metal seals are needed to prevent sand or other dry bulk material from falling through the gate once it is closed. The container is also cheaper to manufacture than existing clamshell gate containers since the gate actuators are provided on the support structure and therefore are entirely separate from the container. Furthermore, the specific design of the rotary actuators and the rotary clamshell gate on the container may enable accurate operation of the gate system even when the container is not aligned precisely with the support structure.

Turning now to the drawings, FIG. 1 is a block diagram of a bulk material handling system 10. The system 10 includes a container 12 elevated on a support structure 14 and holding a quantity of bulk material. The container 12 may utilize a gravity feed to provide a controlled, i.e. metered, flow of bulk material at an outlet 16.

The outlet 16 may be a gravity feed outlet that transfers the bulk material from the container 12 to any desired location. In embodiments where the bulk material handling system 10 is used at a well treatment site, the outlet 16 may transfer the bulk material from the container 12 to a blender. The blender may mix the bulk material with water and other additives to form a fluid mixture (e.g., fracing fluid, cement slurry, drilling mud) for use at the treatment site. It should be noted that the disclosed system 10 may be used in other contexts as well. For example, the bulk material handling system 10 may be used in concrete mixing operations to dispense aggregate from the container 12 through the outlet 16 into a concrete mixing apparatus. In the agricultural industry, the bulk material handling system 10 may be used to transport and dispense various feeds through the outlet 16 of the container 12. Still other applications may be realized for transporting dry bulk material via the container 12 to an elevated location on a support structure 14 and dispensing the bulk material in a metered fashion through the outlet 16.

As illustrated, the container 12 may be elevated above an outlet location via the support structure 14. In some embodiments, the support structure 14 may be configured to support multiple containers 12, instead of just one. In any case, the container(s) 12 may be completely separable and transportable from the support structure 14, such that any container 12 may be selectively removed from the support structure 14 and replaced with another container 12. That way, once the bulk material from the container 12 runs low or empties, a new container 12 may be placed on the support structure 14 to maintain a steady flow of bulk material to an outlet location. In some instances, the container 12 may be closed before being completely emptied, removed from the support structure 14, and replaced by a container 12 holding a different type of bulk material to be provided to the outlet location.

A portable bulk storage system 18 may be provided at a site for storing one or more additional containers 12 of bulk material to be positioned on the support structure 14 for outputting material through the outlet 16. The bulk material containers 12 may be transported to the desired location on a transportation unit (e.g., truck). The bulk storage system 18 may be the transportation unit itself or may be a skid, a pallet, or some other holding area. One or more containers 12 of bulk material may be transferred from the storage system 18 onto the support structure 14, as indicated by arrow 20. This transfer may be performed by lifting the container 12 via a hoisting mechanism, such as a forklift or a crane, or a specially designed container management device.

After one or more of the containers 12 on the support structure 14 are emptied, the empty container(s) 12 may be removed via a hoisting mechanism. In some embodiments, the one or more empty containers 12 may be positioned on another bulk storage system 18 (e.g., a transportation unit, a skid, a pallet, or some other holding area) until they can be removed from the site and/or refilled. In other embodiments, the one or more empty containers 12 may be positioned directly onto a transportation unit for transporting the empty containers 12 away from the site. It should be noted that the same transportation unit used to provide one or more filled containers 12 to the location may then be utilized to remove one or more empty containers 12 from the location.

As illustrated, the containers 12 may each include a rotary clamshell gate 22 for selectively dispensing or blocking a flow of bulk material from the container 12. When the rotary clamshell gate 22 is closed, as shown, the gate 22 may prevent bulk material from flowing from the container 12 to the outlet 16. The rotary clamshell gate 22 may be selectively actuated into an open position (not shown) to release the bulk material from the container 12 into the outlet 16. This actuation generally involves rotating the rotary clamshell gate 22 about a pivot point 24 relative to the container 12 to uncover an opening 26 at the bottom of the container 12, thereby allowing bulk material to flow through the opening 26 and into the outlet 16. When it is desired to stop the flow of bulk material, or once the container 12 is emptied, the rotary clamshell gate 22 may then be actuated (i.e., rotated) back to the closed position to block the flow of bulk material.

In presently disclosed embodiments, the support structure 14 includes one or more actuators 28 used to actuate the rotary clamshell gate 22 of whatever container 12 is positioned on the support structure 14. The one or more actuators 28 may be entirely separate from the container 12 and its corresponding rotary clamshell gate 22. That is, the one or more actuators 28 and the rotary clamshell gate 22 are not collocated on the same structure. The same one or more actuators 28 may be used to open and/or closed the rotary clamshell gates 22 of multiple containers 12 that are positioned on the support structure 14 over time. As described in detail below, the one or more actuators 28 may be rotary actuators, not linear actuators, for engaging and moving the rotary clamshell gate 22 between closed and open positions.

Figure 2:
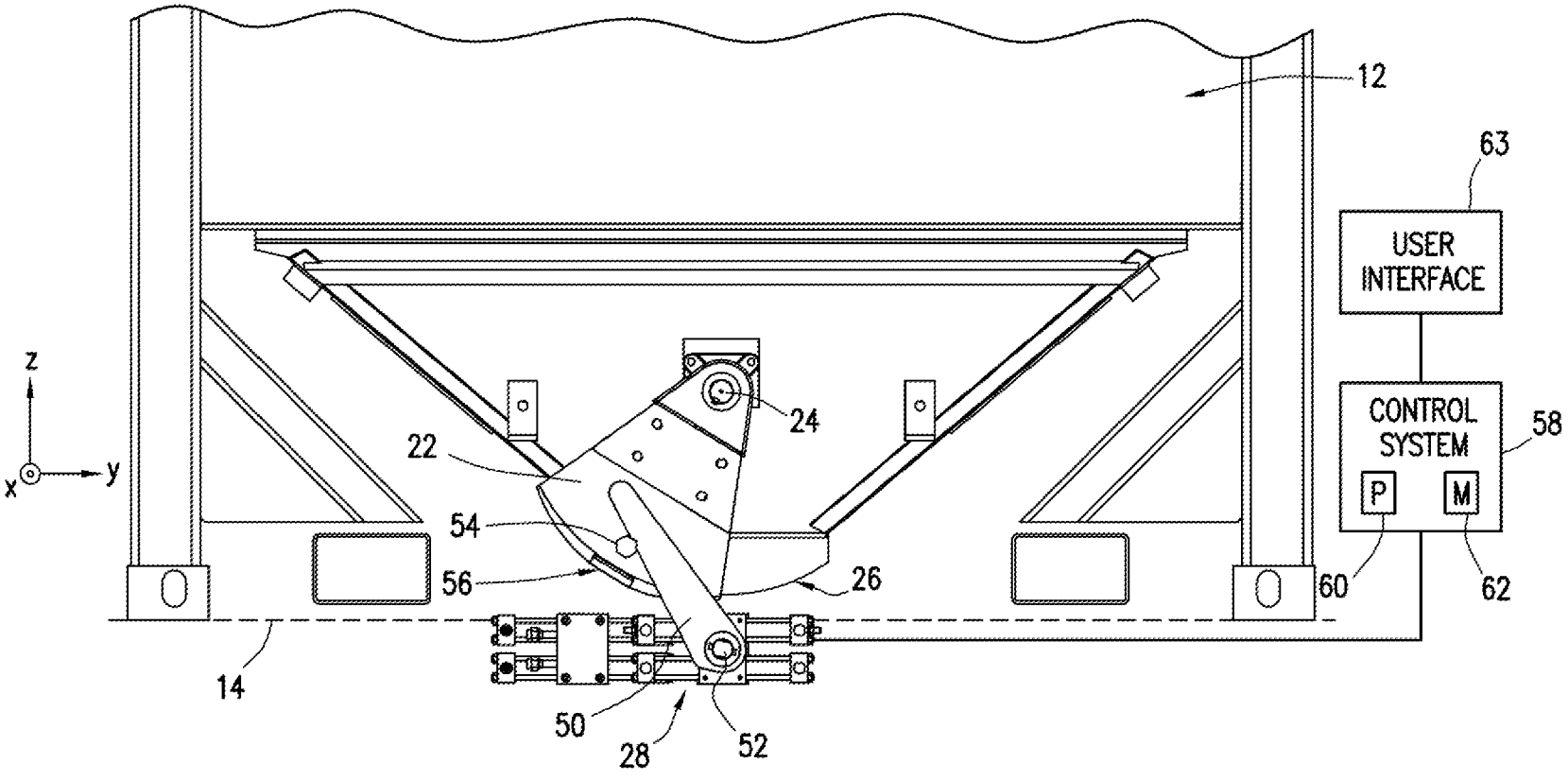
FIG. 2 is a side view of a rotary clamshell gate of a bulk material container being actuated into an open position, in accordance with an embodiment of the present disclosure.

FIG. 2 is a more detailed side view of the transportable container 12 with the rotary clamshell gate 22 being opened by the rotary actuator 28. As noted above, the rotary actuator 28 is not part of the container 12 or the rotary clamshell gate 22; instead, the rotary actuator 28 is part of the support structure 14 (indicated by a dashed line in FIG. 2). The rotary actuator 28 may be disposed on an inner surface of the support structure 14 facing toward the container 12 when the container 12 is disposed on the support structure 14. As shown, the rotary actuator 28 may be positioned to engage and move the rotary clamshell gate 22 into an open position. In this open position, the rotary clamshell gate 22 is rotated off to the side, exposing the opening 26 at the bottom of the container 12.

As mentioned above, the rotary clamshell gate 22 may be used in the transportable bulk material container 12 to provide low-cost and effective sealing of the bulk material within the container 12 throughout its transportation. When closed, the clamshell gate 22 operates to seal bulk material within the container 12 without relying on a metal-to-metal seal between container components. The clamshell gate 22 may cover the container opening 26 and slope upward along both side of the container opening 26 to prevent bulk material from escaping the container 12. The bulk material particles may flow into the space between the opening 26 and the upward sloping clamshell gate 22, but the particles cannot travel upward to escape the space between the opening 26 and the clamshell gate 22. The bulk material trapped between the opening 26 and the gate 22 may create a self-seal due to the angle of repose of the material, thereby keeping the bulk material within the container 12. As such, the clamshell gate 22 may be more reliable and durable for sealing bulk material within the container 12 as compared to other gates (e.g., knife gates) that rely on tight mechanical tolerances between the gate and the container housing.

The clamshell gate 22 described herein may be actuated into the open position via the rotary actuator 28 that is part of the support structure 14. As illustrated, the rotary actuator 28 may include at least one extension arm 50 that is rotatable about a pivot point 52 of the support structure 14. The rotary clamshell gate 22 may include an engagement feature 54 designed to be contacted by the rotating extension arm 50 of the actuator 28. As the actuator 28 rotates the arm 50 about the pivot point 52, the arm 50 may engage and push against the engagement feature 54, thereby pushing the rotary clamshell gate 22 so that it rotates about the pivot point 24 of the container 12. In this manner, the actuator 28 is able to transition the rotary clamshell gate 22 from a closed position to the illustrated open position.

In some embodiments, the engagement feature 54 may include a lateral protrusion extending outward from the rotary clamshell gate 22. In other embodiments, the engagement feature 54 may include a roller (e.g., roller bearing disposed over a lateral protrusion) extending outward from the rotary clamshell gate 22. Adding a roller bearing or similar roller mechanism to the engagement feature 54 may facilitate a relatively smooth transition of rotary force from the arm 50 to the rotary clamshell gate 22. Regardless of the exact type of engagement feature used, a frictional force between the rotating arm 50 and the engagement feature 54 is used to actuate the rotary clamshell gate 22 between the closed and open positions.

In the illustrated embodiment, the engagement feature 54 may be disposed on the rotary clamshell gate 22 at a position above a lower surface 56 of the rotary clamshell gate 22. The term "lower surface" 56 refers to the bottom-most portion of the rotary clamshell gate 22 extending downward away from the rest of the container 12 and toward the support structure 14. This may enable the actuator 28 to interface directly with the rotary clamshell gate 22 while allowing the lower surface 56 of the rotary clamshell gate 22 to extend as far as possible downward from the container 12. This lower positioning of the rotary clamshell gate 22 relative to the container 12 may help to provide a better gravity feed of bulk material exiting the container 12 while producing less dust.

In some embodiments, the actuator arm 50 may only interact with the rotary clamshell gate 22 through a frictional contact between the arm 50 and the engagement feature 54 (e.g., protrusion, roller, etc.). Thus, the actuation of the rotary clamshell gate 22 via the actuator 28 does not rely on the interaction of additional pins, latches, or fasteners. This frictional engagement and actuation of the rotary clamshell gate 22 may enable effective operation of the actuator 28 even when the container 12 is slightly misaligned with the support structure 14.

It may be desirable for the actuator 28 to be capable of handling misalignment between the actual placement and the desired placement of the container 12 on the support structure 14. That way, if the container 12 is not precisely placed on the support structure 14, the actuator 28 may still be able to properly actuate the rotary clamshell gate 22 between the closed and open positions. To that end, the engagement feature 54 may extend far enough in a direction perpendicular to the side surface of the rotary clamshell gate 22 that the rotary actuator 28 would still be able to contact the engagement feature 54 if the container 12 were misaligned in the direction of the X-axis. Similarly, the rotary arm 50 may extend far enough out from the pivot point 52 to reach the engagement feature 54 even if the container 12 were misaligned in the direction of the Y-axis. The system may be designed to handle misalignment of up to approximately 2.5 centimeters in the X-Y plane. As a result, the actuators 28 may be able to move the rotary clamshell gate 22 between the closed and open positions even when the container 12 is not precisely aligned with the support structure.

In some embodiments, the one or more actuators 28 on the support structure may be activated automatically, via electrical, hydraulic, pneumatic, or optical signaling. The actuators 28 may be communicatively coupled (e.g., via a wired connection or wirelessly) to a control system 58 of the bulk material handling system. The control system 58 may be communicatively coupled to several other well site components including, but not limited to, the blender unit, an automated container management device, and various sensors. The control system 58 utilizes at least a processor component 60 and a memory component 62 to monitor and/or control various operations and bulk material transfer at the well site. For example, one or more processor components 60 may be designed to execute instructions encoded into the one or more memory components 62. Upon executing these instructions, the processors 60 may provide passive logging of certain operations at the well site, such as the positions of one or more rotary actuators 28. In some embodiments, the one or more processors 60 may execute instructions for controlling operations of certain well site components, such as the position of the one or more actuators 28 on the support structure 14. Upon receiving a predetermined signal (e.g., open, close, neutral) from the control system 58, each actuator 28 may rotate the arm 50 about the pivot point 52 until it reaches the desired placement corresponding to the received signal. The processors 60 may also output signals at a user interface 63 for instructing operators to remove an empty container from the support structure 14 and replace the container with a new container holding a certain type of bulk material needed for the well treatment. Other types of instructions for inventory control/monitoring may be provided through the disclosed systems.

Figure 3B:
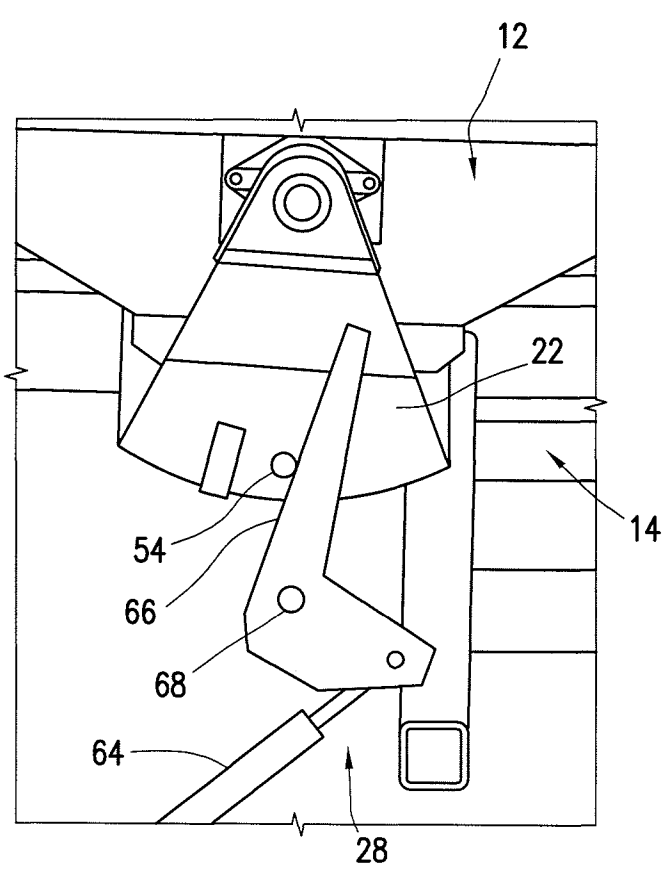
FIGS. 3A-3C are side views of a rotary clamshell gate and an actuator used to position the rotary clamshell gate from a closed position to an open position, in accordance with an embodiment of the present disclosure.
Figure 3A:
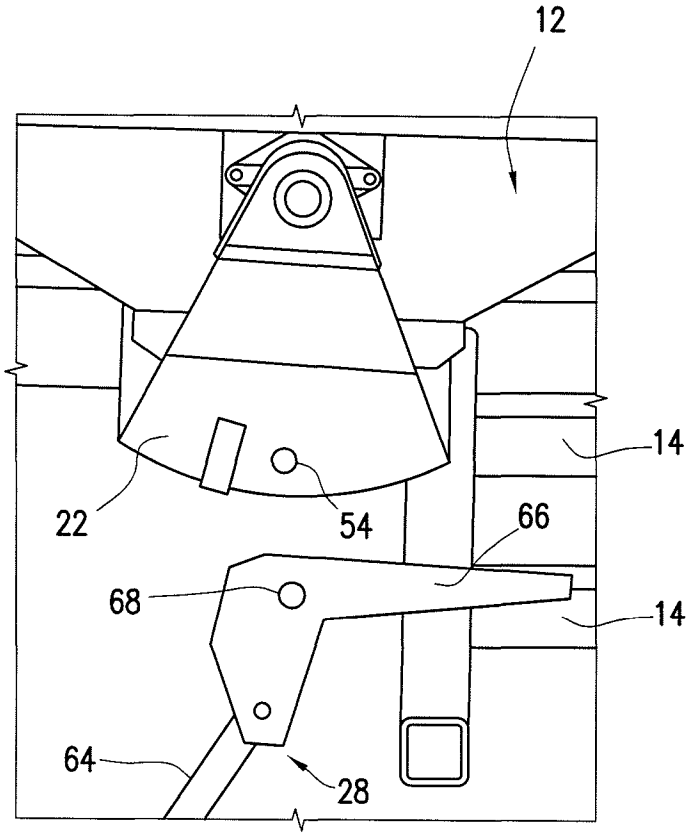
Figure 3C:
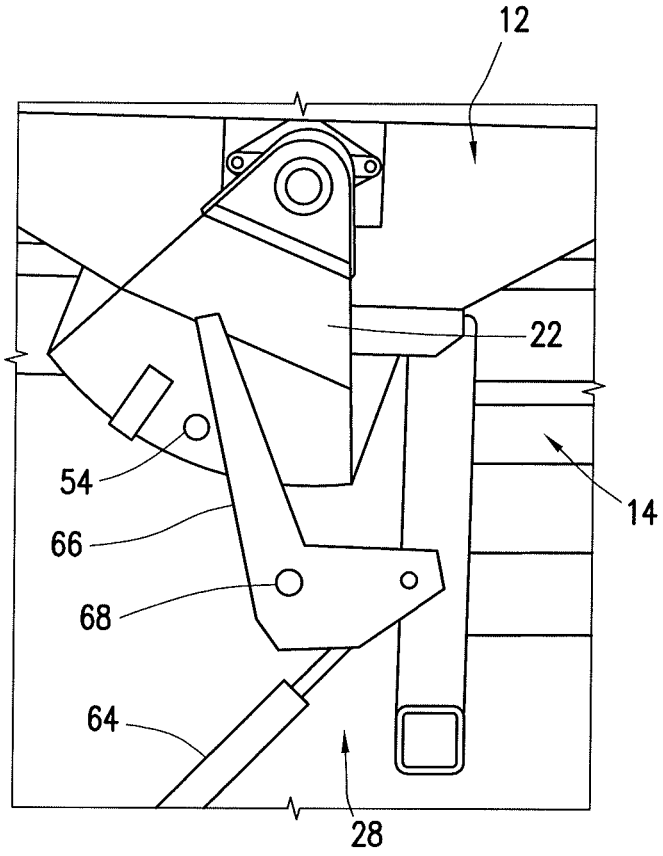

FIGS. 3A-3C illustrate another embodiment of the transportable container 12 having the rotary clamshell gate 22 being opened by a rotary actuator 28. Again, the rotary actuator 28 is not part of the container 12 or the rotary clamshell gate 22; instead, the rotary actuator 28 is part of the support structure 14. In the illustrated embodiment, the rotary actuator 28 may provide the rotary motion needed to move the clamshell gate 22 from the closed position (FIG. 3A) to the open position (FIG. 3C) using a linear actuation mechanism 64 (i.e., piston) coupled to a rotatable lever arm 66. The linear actuation mechanism 64 may be operated electrically, pneumatically, or hydraulically to rotate the lever arm 66. The linear actuation mechanism may be fixed to a mounting point on the support structure 14 at one end and coupled to the lever arm 66 at an opposing end.

As illustrated, the lever arm 66 may include two portions extending in different directions from a pivot point 68. One portion is generally coupled to the piston 64 and the other portion is designed to contact the engagement feature 54 as the lever arm 66 is rotated about the pivot point 68. Other embodiments of the lever arm 66 may be a cam-shaped component, or may take other forms that are rotatable about the pivot point 68 upon the application of a linear translation force to one portion of the lever arm 66.

In FIG. 3A, the rotary actuator 28 is disposed in a neutral position where the lever arm 66 is entirely below an upper surface of the support structure 14. This may enable an operator (or automated system) to remove the container 12 from the support structure 14 and/or to dispose another container 12 onto the support structure 14 above the actuator 28. When the rotary actuator 28 is in this position, the rotary clamshell gate 22 is closed. Upon receiving a desired signal (e.g., from a control system) at the rotary actuator 28, the actuator 28 may extend the linear actuation mechanism 64 outward, thus rotating the lever arm 66 about the pivot point 68 and into an initial engagement with the engagement feature 54 as illustrated in FIG. 3B. Further extension of the linear actuation mechanism 64 may continue to rotate the lever arm 66, which pushes on the engagement feature 54 to rotate the rotary clamshell gate 22 into the open position of FIG. 3C. Still other types of rotary actuators 28 may be employed in other embodiments of the disclosed systems, as described in detail below.

Figure 4A:
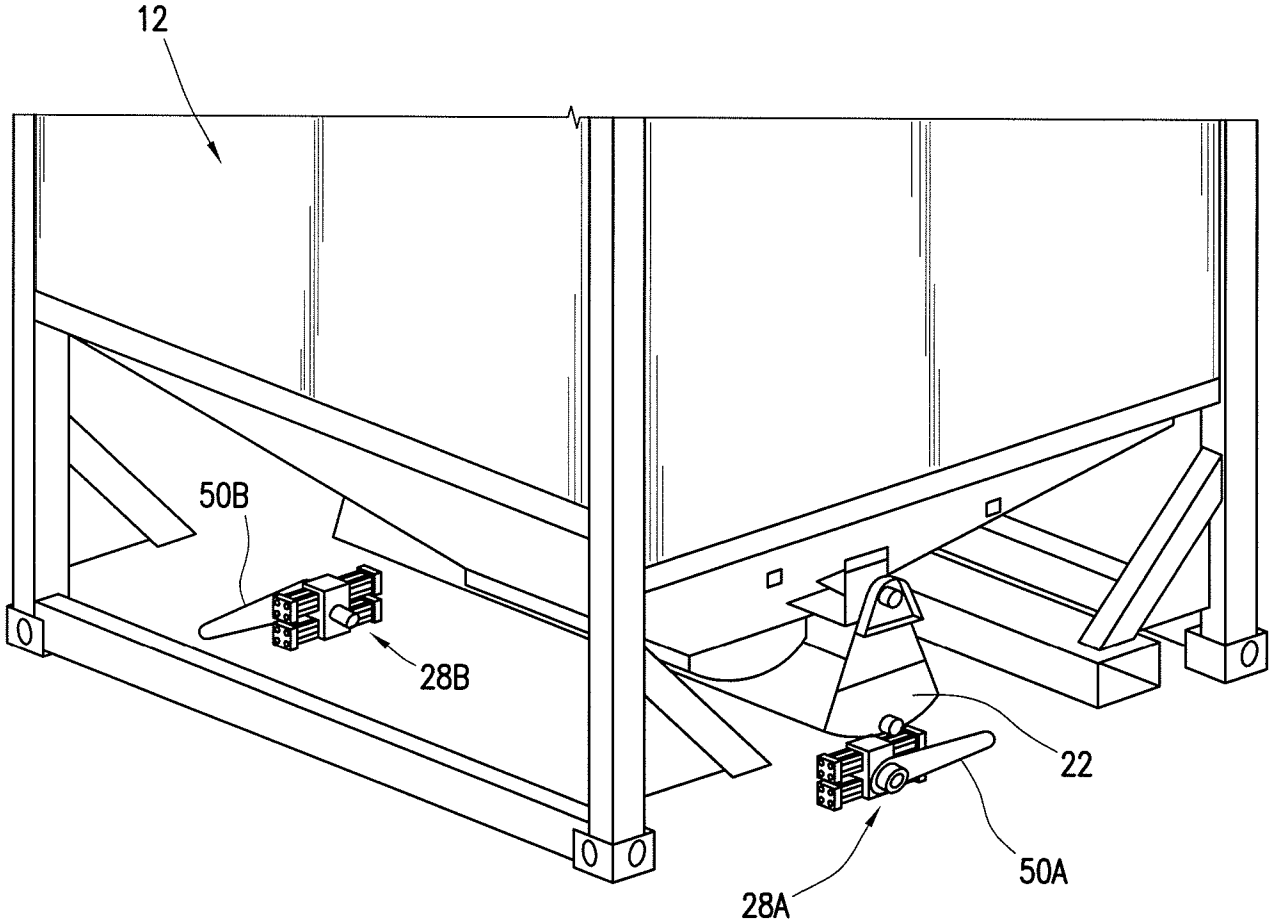
FIGS. 4A-4C are perspective views of a rotary clamshell gate and two actuators used to position the rotary clamshell gate in a neutral, open, and closed position, in accordance with an embodiment of the present disclosure.
Figure 4B:
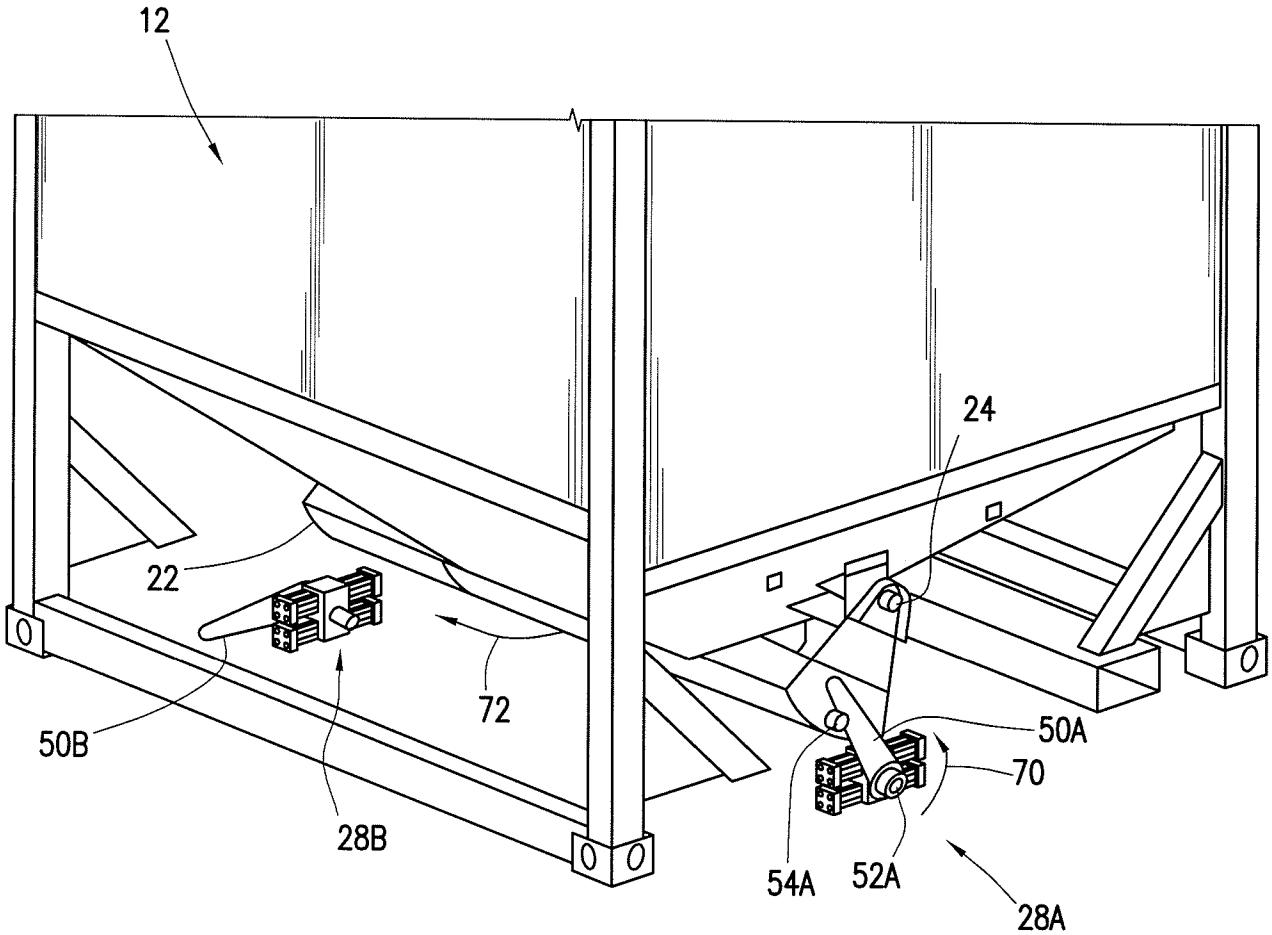
Figure 4C:
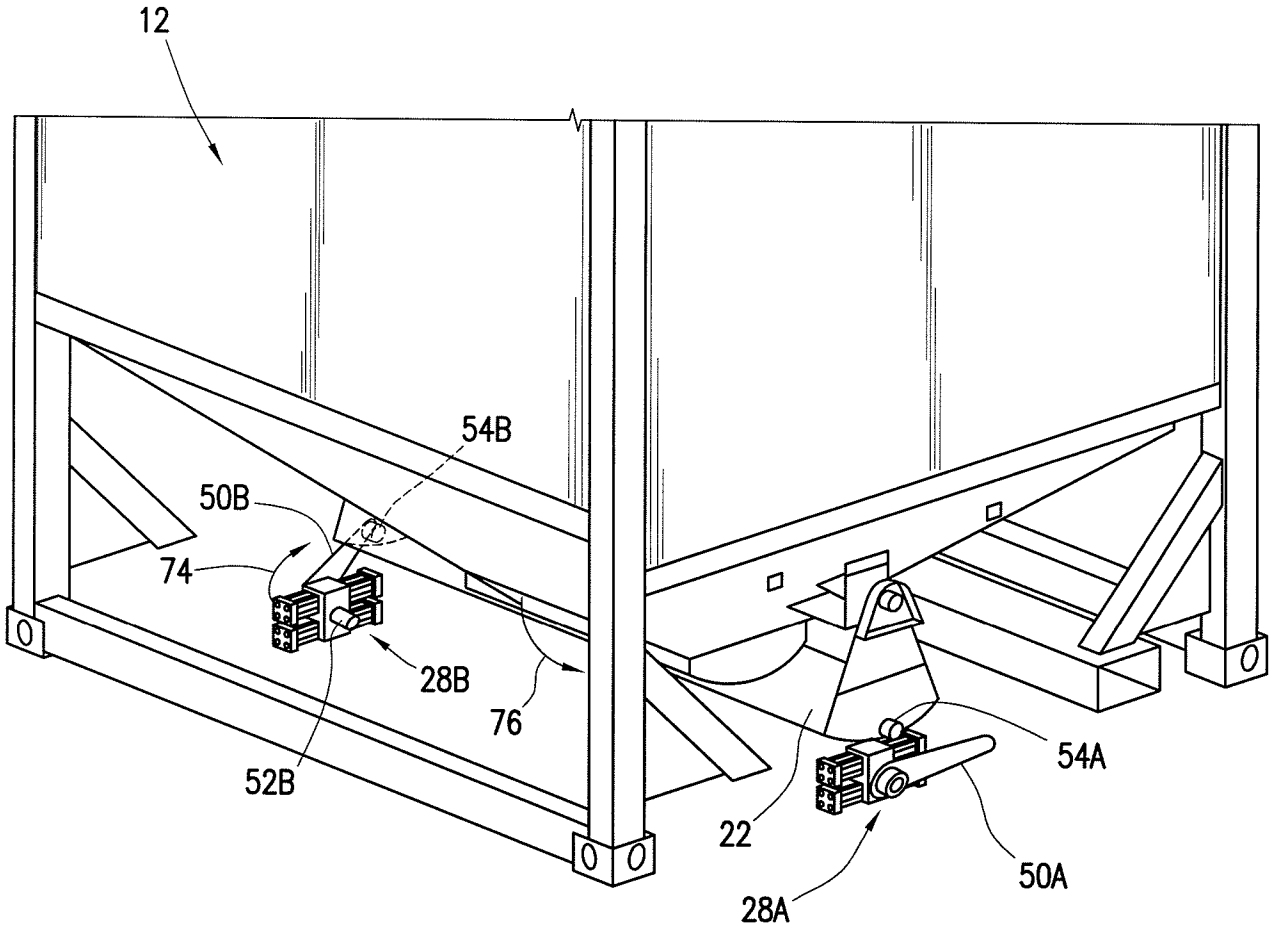

FIGS. 4A-4C provide a perspective view of the container 12 with the rotary clamshell gate 22 being actuated by a set of two rotary actuators 28 disposed in a neutral position, an open position, and a closed position. In the illustrated embodiment, the support structure (not shown) features two rotary actuators 28A and 28B for transitioning the rotary clamshell gate 22 between the closed and open positions. The rotary actuators 28A and 28B may be disposed on opposite sides of the support structure. One of the actuators 28A may be used to engage and urge the rotary clamshell gate 22 into the open position, while the other actuator 28B may be used to return the rotary clamshell gate 22 to the closed position. Different arrangements and placements of one or more actuators 28 on the support structure may be utilized in other embodiments, as described below.

FIG. 4A illustrates the two actuators 28 disposed in a neutral position. The actuators 28 may be disposed in the neutral position when neither of the actuators 28 are being activated (e.g., by control system 60 of FIG. 2). In the illustrated embodiment, this neutral position may involve both actuator arms 50A and 50B being laid down and generally aligned with a horizontal plane of the support structure. However, the neutral position of the actuator arms 50A and 50B may be different in other embodiments. When the actuators 28A and 28B are in the neutral position, the corresponding actuator arms 50A and 50B are positioned so that they do not interfere with the rotary clamshell gate 22. As a result, the rotary clamshell gate 22 is in a closed position when the actuators 28A and 28B are in the neutral position of FIG. 4A.

The container 12 may be loaded onto or unloaded from the support structure when the actuators 28A and 28B are disposed in the neutral position. As such, it may be desirable for the entire length of both actuator arms 50A and 50B to be kept below an upper surface of the support structure when they are in the neutral position. This keeps the actuator arms 50A and 50B out of the way of the container 12 being lifted onto the support structure. With the actuators 28A and 28B in the neutral position, an operator has more freedom to load/unload the containers 12 from the support structure. The actuators 28A and 28B may initially default to the neutral position, allowing an operator to place the first container 12 thereon without having to adjust the position of the actuators 28A and 28B or lift the container 12 above a certain point.

In the illustrated embodiment, the support structure may include two actuators 28A and 28B, one to move the rotary clamshell gate 22 into the open position of FIG. 4B and the other to move the rotary clamshell gate 22 back into the closed position of FIG. 4C. As shown in FIG. 4B, the actuator 28A may be activated to rotate the actuator arm 50A in a counterclockwise direction (arrow 70) with respect to the pivot point 52A. The rotating actuator arm 50A may then contact and push against a first engagement feature 54A on the rotary clamshell gate 22. Further movement of the actuator arm 50A may rotate the rotary clamshell gate 22 in a clockwise direction (arrow 72) relative to the pivot point 24 on the container 12 until the clamshell gate 22 reaches the open position. In the open position, the rotary clamshell gate 22 allows bulk material to flow out through the opening in the bottom of the container 12. The weight of the bulk material moving through the rotary clamshell gate 22, in addition to the actuator 28A, may maintain the rotary clamshell gate 22 in the open position.

To close the rotary clamshell gate 22, the actuator 28B may be activated to rotate the actuator arm 50B in a clockwise direction (arrow 74) with respect to the pivot point 52B. The rotating actuator arm 50B may then contact and push against a second engagement feature 54B on an opposite side of the rotary clamshell gate 22 from the engagement feature 54A. Further movement of the actuator arm 50B may rotate the rotary clamshell gate 22 in a counterclockwise direction (arrow 76) relative to the pivot point 24 on the container 12 until the clamshell gate 22 reaches the closed position. In the closed position, the rotary clamshell gate 22 stops the flow of bulk material out of the opening in the bottom of the container 12. The weight of the bulk material piled on top of the rotary clamshell gate 22 may maintain the rotary clamshell gate 22 in the closed position, allowing the actuator 28B to be returned to its neutral position once the gate 22 is closed.

The actuators 28A and 28B may each be designed to rotate only a certain amount around their respective pivot points 52A and 52B. For example, the actuator 28A may be rotatable between the neutral position of FIG. 4A and the activated position of FIG. 4B, while the actuator 28B may be rotatable between the neutral position of FIG. 4A and the activated position of FIG. 4C.

In some embodiments, the container 12 may be designed such that the rotary clamshell gate 22 can be opened/closed by rotating the gate 22 in only one direction (e.g., clockwise) relative to the pivot point 24 on the container 12. Having two actuators 28A and 28B disposed on opposite sides of the support structure may enable the system to effectively actuate the rotary clamshell gate 22 between the closed and open positions, regardless of which way the container 12 is facing when it is loaded onto the support structure. For example, the actuators 28A and 28B would still be able to open/close the rotary clamshell gate 22 if the container 12 was loaded in an opposite orientation with respect to the support structure as shown in FIGS. 4A-4C. In this opposite orientation, the actuator 28B may push against the engagement feature 54A to rotate the rotary clamshell gate 22 into the open position and the actuator 28A may push against the engagement feature 54B to rotate the rotary clamshell gate 22 back into the closed position. Thus, having two actuators 28A and 28B to perform separate opening and closing functions may allow an operator to load the container 12 onto the support structure from either side.

Figure 5:
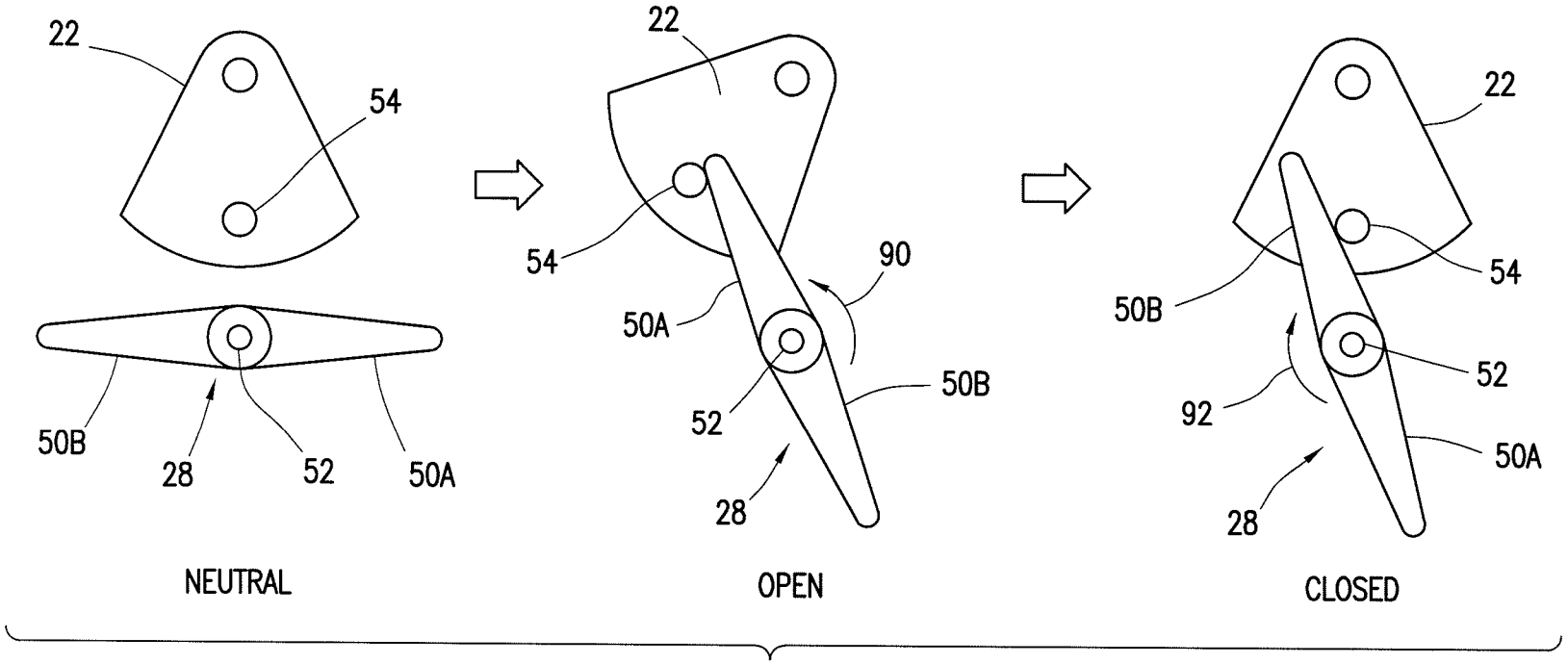
FIG. 5 is a schematic view of a rotary clamshell gate and a bidirectional actuator used to position the rotary clamshell gate in a neutral, open, and closed position, in accordance with an embodiment of the present disclosure.

The illustrated embodiment of FIGS. 4A-4C features two actuators 28A and 28B each designed to actuate the rotary clamshell gate 22 in a single direction between the closed and open positions. However, other embodiments may include bidirectional actuators designed to actuate the rotary clamshell gate in both directions. FIG. 5 schematically illustrates one example of a bidirectional actuator 28. The bidirectional actuator 28 may include two actuator arms 50A and 50B extending in opposite directions from each other. In the neutral position, the actuator 28 may be positioned with the actuator arms 50A and 50B in horizontal alignment, so that the container may be easily moved on and off the support structure. To open the rotary clamshell gate 22, the actuator 28 may rotate in a counterclockwise direction (arrow 90) about the pivot point 52 to bring the first actuator arm 50A into contact with the engagement feature 54, as shown. To close the rotary clamshell gate 22, the actuator 28 may rotate in a clockwise direction (arrow 92) about the pivot point 52 to bring the second actuator arm 50B into contact with the engagement feature 54.

Figure 6:
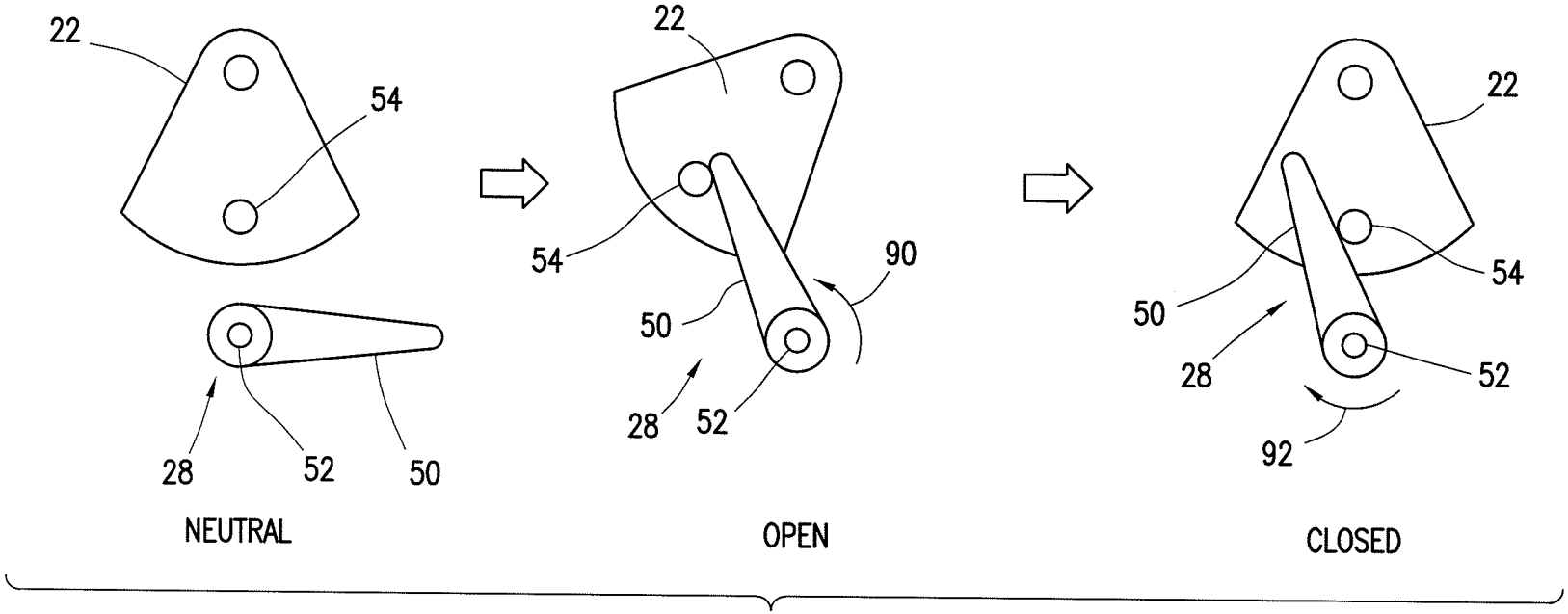
FIG. 6 is a schematic view of a rotary clamshell gate and a bidirectional actuator used to position the rotary clamshell gate in a neutral, open, and closed position, in accordance with an embodiment of the present disclosure.

FIG. 6 illustrates another embodiment of a bidirectional actuator 28, similar to the one described with reference to FIG. 5. This bidirectional actuator 28 may include just a single actuator arm 50 extending from the pivot point 52. The single actuator arm 50 may be controlled to rotate a full 360 degrees about the pivot point 52 to open/close the rotary clamshell gate 22 as shown.

In some embodiments, the bidirectional actuators 28 described herein may be applied to just one side of the support structure. In other embodiments, two similar bidirectional actuators 28 may be disposed on opposite sides of the support structure to engage opposing engagement features 54 of the rotary clamshell gate 22 at the same time to move the rotary clamshell gate 22 between the closed and open positions.

In other embodiments, the support structure may include a single actuator 28 designed to actuate the rotary clamshell gate 22 into just the open position, and the container 12 may be equipped with one or more springs to return the gate 22 to the closed position. In such instances, the springs may only function to close the rotary clamshell gate 22 once the container 12 is completely emptied of bulk material. If it is desirable to close the rotary clamshell gate 22 before the container 12 is fully emptied, the clamshell gate 22 may have to be actuated closed via one or more actuators 28.

Figure 7:
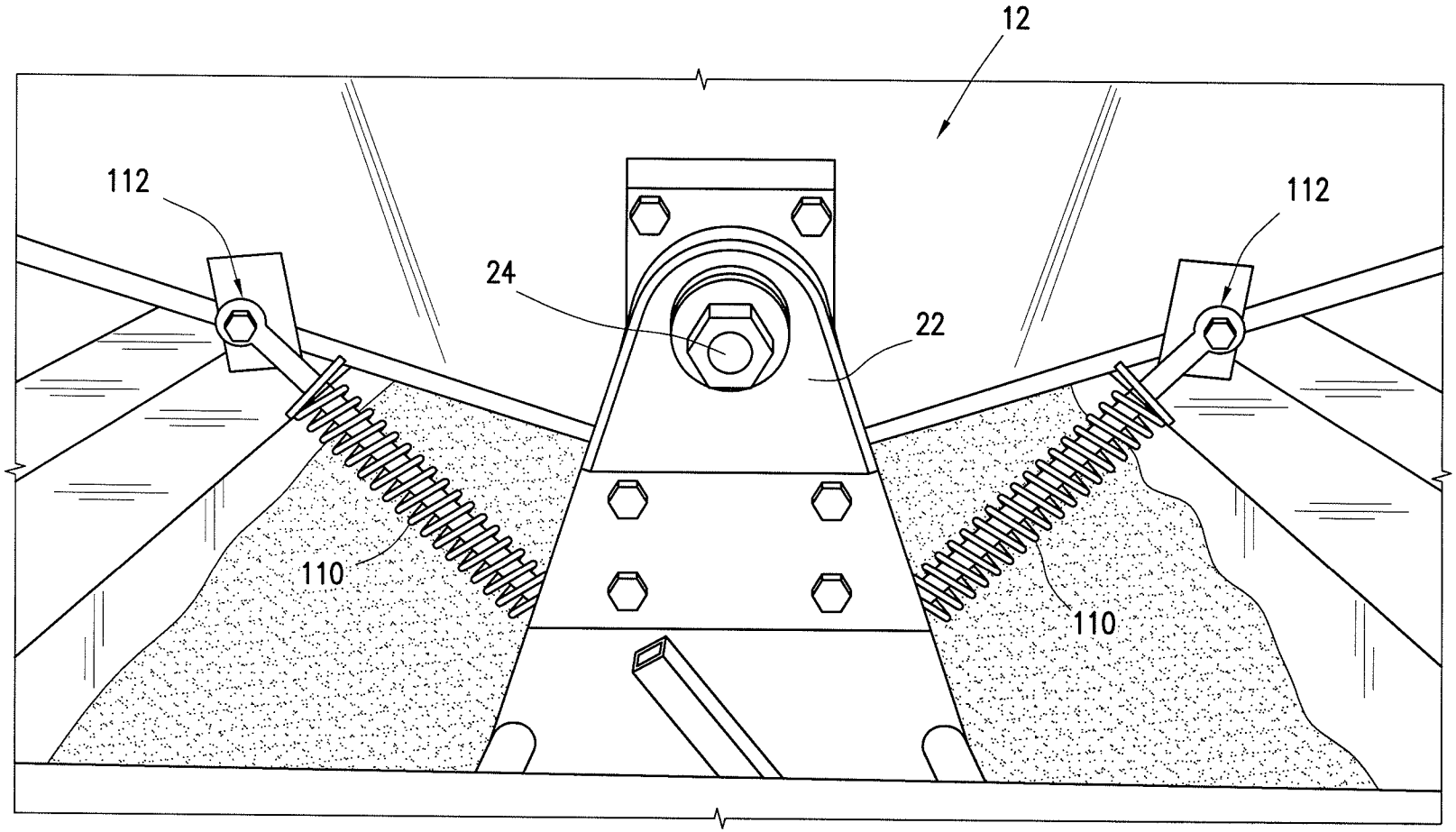
FIG. 7 is a side view of a container having a rotary clamshell gate coupled to the container by springs, in accordance with an embodiment of the present disclosure.

FIG. 7 illustrates an embodiment of the container 12 equipped with springs 110 for biasing the rotary clamshell gate 22 toward the closed position. The springs 110 may include linear springs, torsional springs, compression springs, or some other biasing mechanism. As illustrated, the springs 110 may be used to couple both sides of the rotary clamshell gate 22 to two other locations 112 on the container 12. In other embodiments, one or more springs 110 may couple just one side of the rotary clamshell gate 22 to another location 112 on the container 12. The springs 110 can be attached to different locations 112 on the container 12 than those illustrated in FIG. 7.

Figure 8:
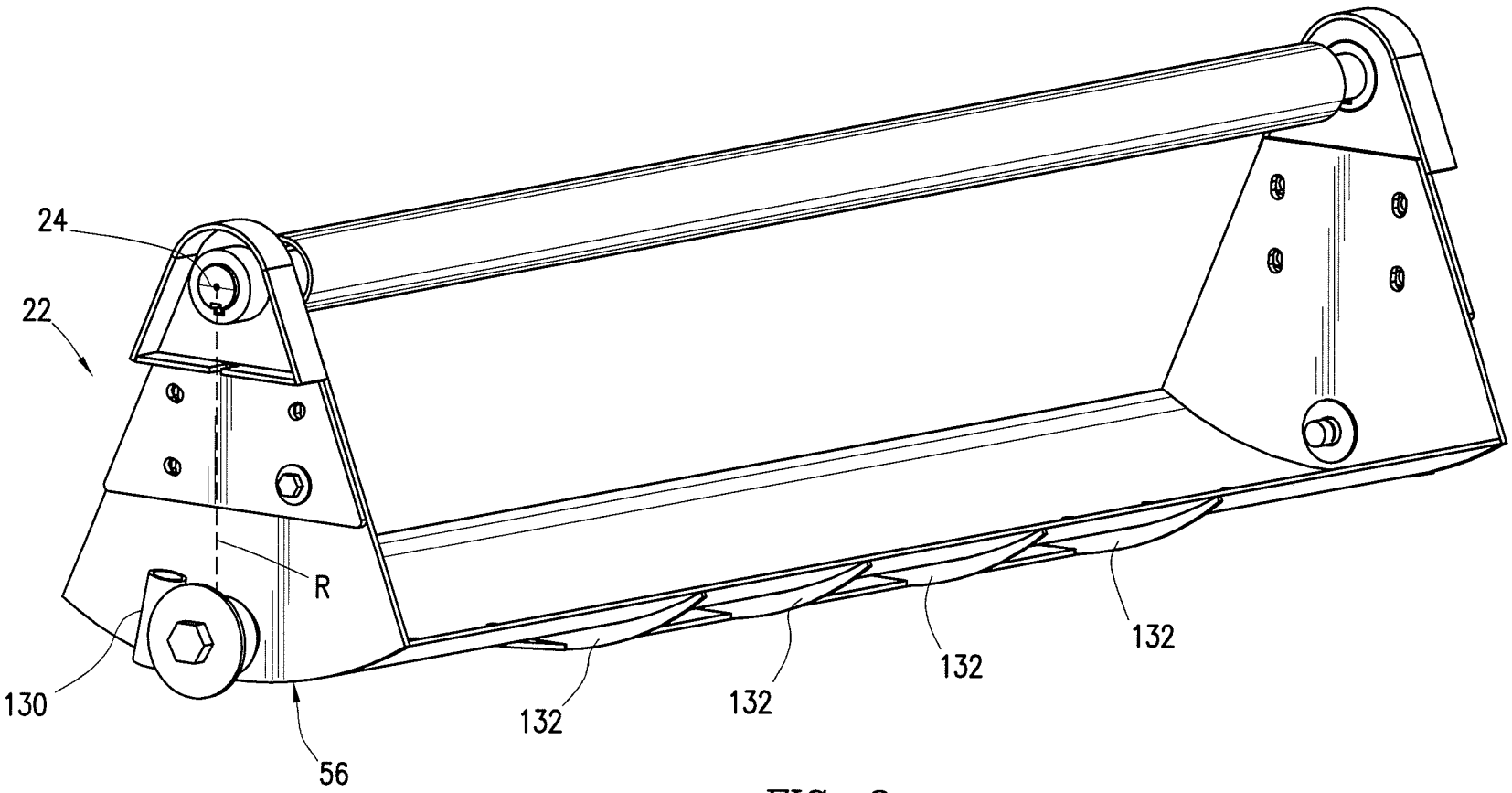
FIG. 8 is a perspective view of a rotary clamshell gate for use in a portable bulk material container, in accordance with an embodiment of the present disclosure.

FIG. 8 illustrates an embodiment of the rotary clamshell gate 22 with features that enable relatively easy manipulation of the gate 22. First, the rotary clamshell gate 22 may include a manual actuation engagement feature 130 for enabling manual actuation of the rotary clamshell gate 22 in the event that one or more of the automated actuators (28) are not operating properly. The manual actuation engagement feature 130, as illustrated, may be a piece of hollow tubing coupled to an end of the rotary clamshell gate 22. An operator may slide a bar into the tubing and use the bar to lift the rotary clamshell gate 22 into a desired orientation. In presently disclosed embodiments, the automatic rotary actuators are coupled to the support structure and completely separate from the rotary clamshell gate 22. As a result, an operator may only have to overcome the weight of the gate 22 itself to manipulate the gate into a desired position, without having to overcome any additional force from actuator system.

In FIG. 8, the radius of curvature of the lower surface 56 of the rotary clamshell gate 22 is approximately equal to a swing radius R through which the rotary clamshell gate 22 is designed to rotate relative to the pivot point 24 during opening/closing. This may be particularly desirable in instances where the container releases bulk material into a gravity-fed pile of bulk material extending through a chute below the rotary clamshell gate 22. By making the radius of curvature of the lower surface 56 approximately equal to the swing radius R, the rotary clamshell gate 22 may be able to cut through this pile of bulk material during opening/closing motions without fighting a large amount of drag in either direction. This reduces the torque output required by the one or more actuators used to move the rotary clamshell gate 22.

In addition, the rotary clamshell gate 22 may include various other structural reinforcements that help reduce the amount of torque on the actuator(s) of the system. The illustrated clamshell gate 22 includes a number of reinforcement ribs 132 disposed along the bottom of the rotary clamshell gate 22. These ribs 132 may provide increased torsional support to the rotary clamshell gate 22, particularly in embodiments where the rotary clamshell gate 22 is elongated and actuated from one end at a time. In this way, the ribs 132 may provide additional stability for the rotary clamshell gate 22 as it is actuated between the closed and open positions.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a support structure; and a container holding dry bulk material, wherein the container is portable and removably disposed on the support structure, wherein the container comprises a rotary clamshell gate for selectively releasing at least a portion of the dry bulk material from the container; and wherein the support structure comprises one or more rotary actuators for selectively actuating the rotary clamshell gate of the container between a closed position and an open position, wherein each of the one or more rotary actuators is a fixed length rotary arm rotatably connected to a pivot point on the support structure;

wherein the rotary clamshell gate comprises an engagement mechanism for interfacing with the fixed length rotary arm such that rotation of the fixed length rotary arm about the pivot point actuates the rotary clamshell gate from the closed position to the open position.

2. The system of claim 1, wherein the engagement mechanism is disposed on the rotary clamshell gate at a position above a lower surface of the rotary clamshell gate.

3. The system of claim 1, wherein the fixed length rotary arm interfaces with the rotary clamshell gate via a frictional engagement.

4. The system of claim 1, wherein the one or more rotary actuators are selectively rotatable into a neutral orientation where the one or more rotary actuators are disposed entirely below an upper surface of the support structure.

5. The system of claim 1, further comprising a control system communicatively coupled to the one or more rotary actuators for operating the one or more rotary actuators to control a position of the rotary clamshell gate.

6. The system of claim 1, wherein the rotary clamshell gate comprises a manual actuation engagement feature for enabling manual actuation of the rotary clamshell gate.

7. The system of claim 1, wherein each of the one or more rotary actuators is configured to directly contact the rotary clamshell gate in response to rotation of the rotary arm with respect to the pivot point of the support structure.

8. The system of claim 1, wherein a first rotary actuator of the one or more rotary actuators is configured to move from a position not in contact with the rotary clamshell gate to a position in contact with the rotary clamshell gate via rotation about the pivot point and to actuate the rotary clamshell gate from the closed position to the open position in response to contact of the rotary arm with the clamshell gate and continued rotation of the rotary arm about the pivot point.

9. The system of claim 1, wherein the rotary clamshell gate comprises an arc-shaped lower surface extending axially between two end faces, wherein the two end faces are rotatably secured to another portion of the container at pivot points, and wherein the rotary clamshell gate is configured to be rotated about an axis of the pivot points to open and close the container.

10. A system, comprising:

a support structure for receiving a separate and portable container having a rotary clamshell gate for dispensing dry bulk material from the container, wherein the support structure comprises one or more rotary actuators for selectively actuating the rotary clamshell gate of the container between a closed position and an open position by interfacing with an engagement mechanism of the rotary clamshell gate;

wherein each of the one or more rotary actuators is a fixed length rotary arm rotatably connected to a pivot point on the support structure such that rotation of the fixed length rotary arm about the pivot point actuates the rotary clamshell gate from the closed position to the open position.

11. The system of claim 10, wherein the one or more rotary actuators comprise a first actuator disposed on a first side of the support structure for actuating the rotary clamshell gate from the closed position to the open position, and a second actuator disposed on a second side of the support structure opposite the first side for actuating the rotary clamshell gate from the open position to the closed position.

12. The system of claim 10, wherein the one or more rotary actuators comprise a single bidirectional rotary actuator having the fixed length arm extending from the pivot point to actuate the rotary clamshell gate from the closed position to the open position, and a second fixed length rotary arm extending from the pivot point to actuate the rotary clamshell gate from the open position to the closed position.

13. The system of claim 10, wherein the one or more rotary actuators comprise a single rotary actuator comprising the fixed length rotary arm extending from the pivot point, wherein the fixed length rotary arm is rotatable 360 degrees about the pivot point to actuate the rotary clamshell gate between the closed position and the open position.

14. A method, comprising:

receiving a container holding dry bulk material onto a support structure, wherein the container comprises a rotary clamshell gate and is separate from the support structure;

rotating an actuator arm of the support structure in a first direction to engage and actuate the rotary clamshell gate from a closed position to an open position, wherein the actuator arm is a fixed length rotary arm rotatably connected to a pivot point on the support structure; and dispensing at least a portion of the dry bulk material from the container via the rotary clamshell gate disposed in the open position.

15. The method of claim 14, further comprising rotating a second actuator arm of the support structure to engage and actuate the rotary clamshell gate from the open position to the closed position, wherein the second actuator arm is a fixed length rotary arm rotatably connected to another pivot point on the support structure.

16. The method of claim 14, further comprising rotating the actuator arm in a second direction opposite the first direction to engage and actuate the rotary clamshell gate from the open position to the closed position.

17. The method of claim 14, further comprising biasing the rotary clamshell gate toward the closed position via one or more springs coupled between the rotary clamshell gate and another location on the container.

18. The method of claim 14, further comprising maintaining the actuator arm in an orientation such that the actuator arm remains below an upper surface of the support structure while receiving the container onto the support structure.

19. The method of claim 14, further comprising engaging and actuating the rotary clamshell gate from the closed position to the open position via the actuator arm when the container is misaligned by up to 2.5 centimeters with respect to the support structure.

* * * * *